United States Patent [19]

Landgraf et al.

[11] 4,060,227

[45] Nov. 29, 1977

[54] FOLDER

[75] Inventors: Glenn A. Landgraf; Fred H. Ebel, both of Boca Raton, Fla.

[73] Assignee: Gold Thread Machinery Co., Boca Raton, Fla.

[21] Appl. No.: 700,752

[22] Filed: June 29, 1976

[51] Int. Cl.[2] ..... B65H 45/22

[52] U.S. Cl. ..... 270/66; 270/69; 270/82

[58] Field of Search ..... 270/66, 69, 80–86

[56] References Cited

U.S. PATENT DOCUMENTS

| | | | |
|---|---|---|---|
| 2,754,113 | 7/1956 | Sjostrom | 270/69 X |
| 3,190,640 | 6/1965 | Sjostrom | 270/66 |
| 3,829,081 | 8/1974 | Gerstenberger | 270/86 X |

*Primary Examiner*—Edward M. Coven
*Assistant Examiner*—A. Heinz
*Attorney, Agent, or Firm*—Wolf, Greenfield & Sacks

[57] ABSTRACT

A small piece folder capable of forming both a French fold and cross fold includes a feed belt on which the unfolded articles are initially placed. Adjustable width control blades overlie the feed belt, and the margins of the article are pneumatically blown over the edges of the blades in sequence to form the French fold. The cross fold is also pneumatically initiated at the end of the feed belt.

7 Claims, 8 Drawing Figures

FOLDER

INTRODUCTION AND BACKGROUND

This invention relates to small piece folders and more particularly comprises a machine capable of forming both French folds and cross folds in small articles.

At the present time there are a variety of machines available which are capable of automatically folding articles. These machines are quite large and expensive. The principal object of this invention is to provide a small piece folder which is relatively small in size as well as inexpensive, so that several such machines may be used in parallel at the output end of an ironer to increase the operator's capacity within a limited area and budget.

In the present invention pneumatic means are provided in the machine for folding the article. The margins of the article are literally blown over control blades which overlie the article, and the absence on the machine of mechanical devices for forming the folds enables the control blades to be easily adjusted so that the machine may accommodate articles of different sizes. Similarly, the cross fold formed on the machine is achieved by a pneumatic control which blows the article along the line to be folded between a pair of pinch rollers. This simple arrangement with very few mechanically moving parts provides trouble free operation. Furthermore, the folds are formed in the article as the article moves on continuously moving conveyors. The absence of stopping and starting of the principal conveyor belts in the machine reduces wear and increases the machine capacity. The machine also includes a stacker assembly that receives the fully folded articles and deposits them one at a time in a stack at the bottom of the machine frame from which point they may be conveyed for bundling and storing.

These and other objects and features of this invention will be better understood and appreciated from the following detailed description of one embodiment thereof, selected for purposes of illustration and shown in the accompanying drawing:

BRIEF FIGURE DESCRIPTION

DETAILED DESCRIPTION

Figure 1:
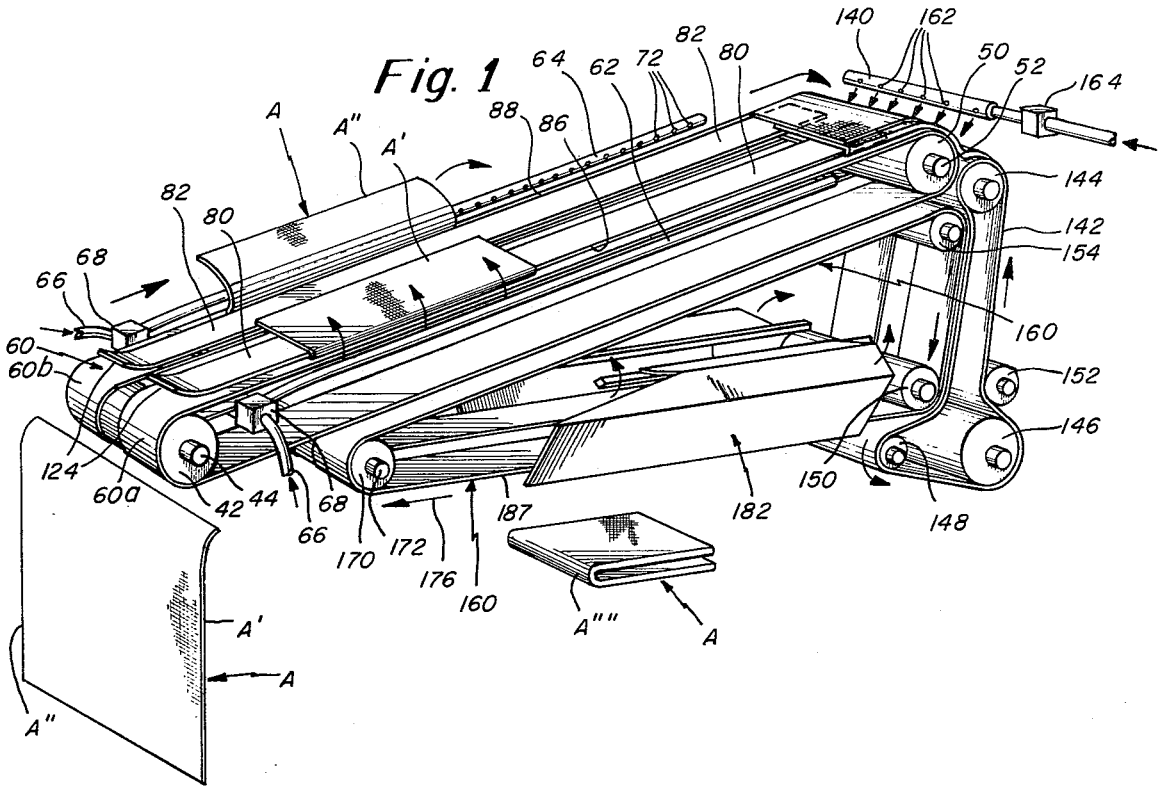
FIG. 1 is a perspective view, somewhat diagrammatic, of the machine of this invention and illustrating how the folds are formed.

The small piece folder shown in the drawing is ordinarily used in combination with an ironer to fold articles after they have been ironed flat. Typically the folder is used to fold towels or similar sized flat articles, which are to be folded with one or more length folds and a cross fold. More particularly, the machine is adapted to form first a French fold or three-panel fold lengthwise of the article and thereafter form a cross fold in the article.

The folder shown in the drawing is built on a frame 10 which is approximately 25 inches wide and 60 inches long. The frame includes corner posts 12 at the front end of the machine (the left side in FIG. 2) and corner posts 14 at the rear end of the machine. Fixed casters 16 support the rear end, and pivotally mounted casters 18 support the frame at the front. The front and back corner posts are interconnected by beams 20 at the bottom, beams 22 intermediate their ends, and beams 24 at the top. The sides of the frame in turn are interconnected by a number of cross braces 26, 28 and 30 at the bottom, center, and top, respectively.

The frame 10 carries an inclined platform 40 that extends from a position forwardly of the front posts 12 and above cross brace 28, rearwardly and upwardly to a position adjacent the rear posts 14 but slightly below the cross brace 30. A roller 42 mounted on shaft 44 extends between the side panels 46 that lie along the sides of platform 40, and the upper periphery of roller 42 is substantially tangential with the platform surface 41. Drive roller 50 supported on shaft 52 which in turn extends between plates 54 forming part of the frame has its upper periphery disposed substantially tangential to the rear end of the platform surface 41, and a pair of conveyor belts 60 denoted separately as **60*a* and 60*b* are supported on the rollers 42 and 50. The endless belts 60 which are hereafter sometimes referred to as the feed belts carry the articles to be folded by the machine from the front or feed end of the frame rearwardly along surface 41 of platform 40. This surface 41 is coincident with the upper run of belts 60. The lengthwise folds are made as the articles travel on the feed conveyor belts 60**.

A pair of air tubes 62 and 64 extend along the upper course of the feed conveyor belts 60 just outwardly of the side panels 46, and each air tube is connected to a source of compressed air by its own air hose 66 through an appropriate valve assembly 68. As the piece to be folded is carried along surface 41 by feed belts 60, the sides of the article overlap and slide along the air tubes 62 and 64. A series of blow ports 70 are formed in the forward portion of tube 62 through which jets of air are blown when air under pressure is supplied to the tube. A similar array of blow ports 72 are formed in air tube 64 at its rear portion, through which jets of air are blown when the valve assembly controlling air flow to tube 64 is opened.

Figure 3:
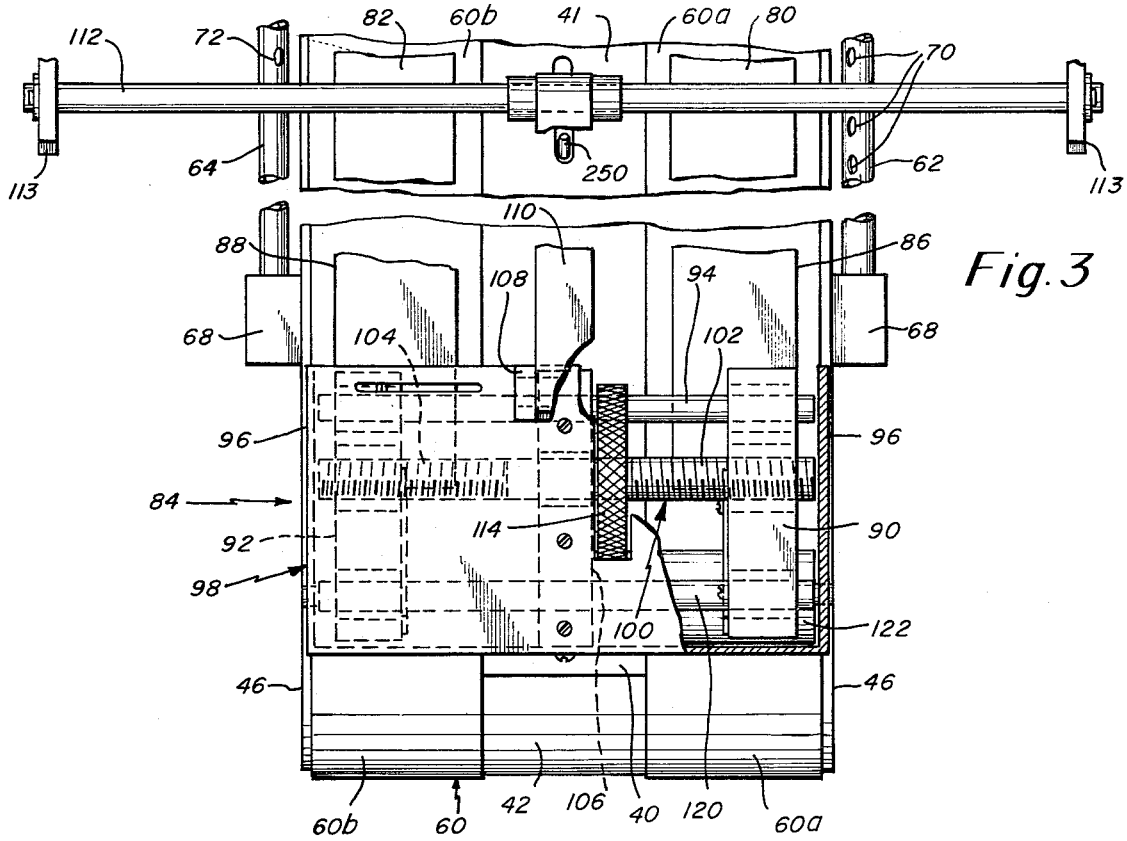
FIG. 3 is a fragmentary top view of the machine as suggested by the sight line 3—3 of FIG. 2 and particularly showing the control blade adjusting assembly.
Figure 4:
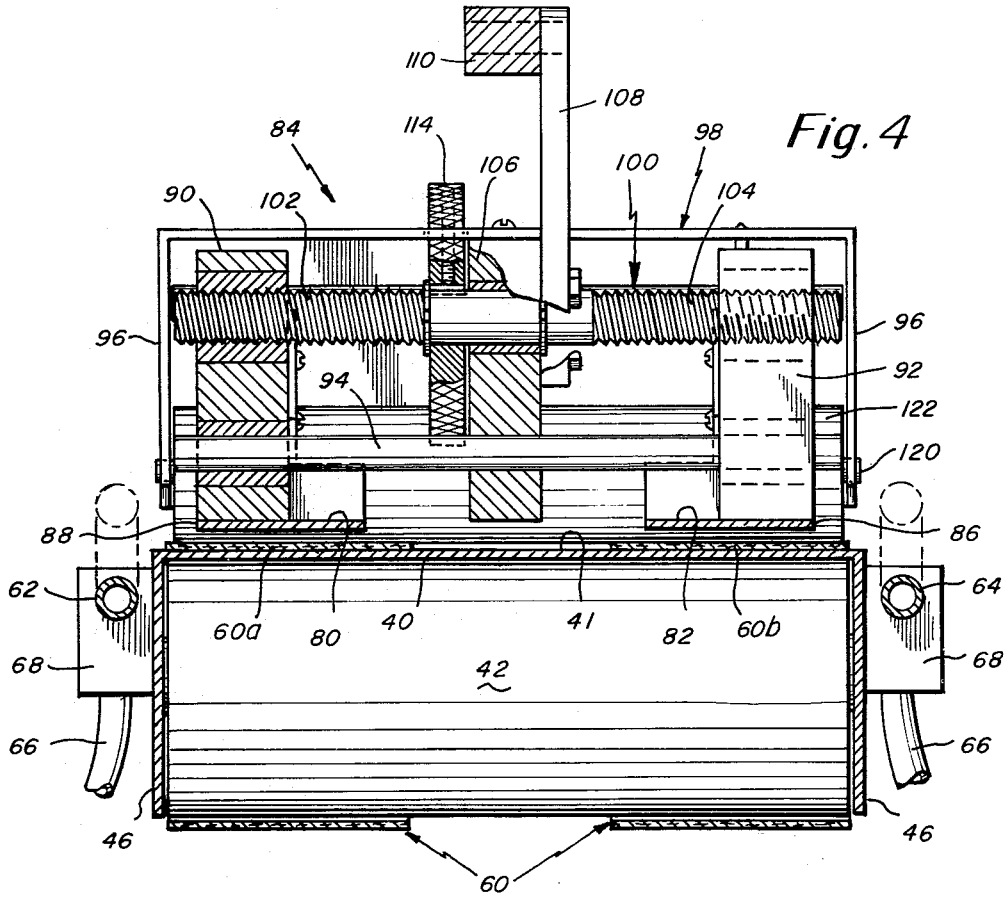
FIG. 4 is a cross sectional view taken along section line 4—4 of FIG. 2.
Figure 5:
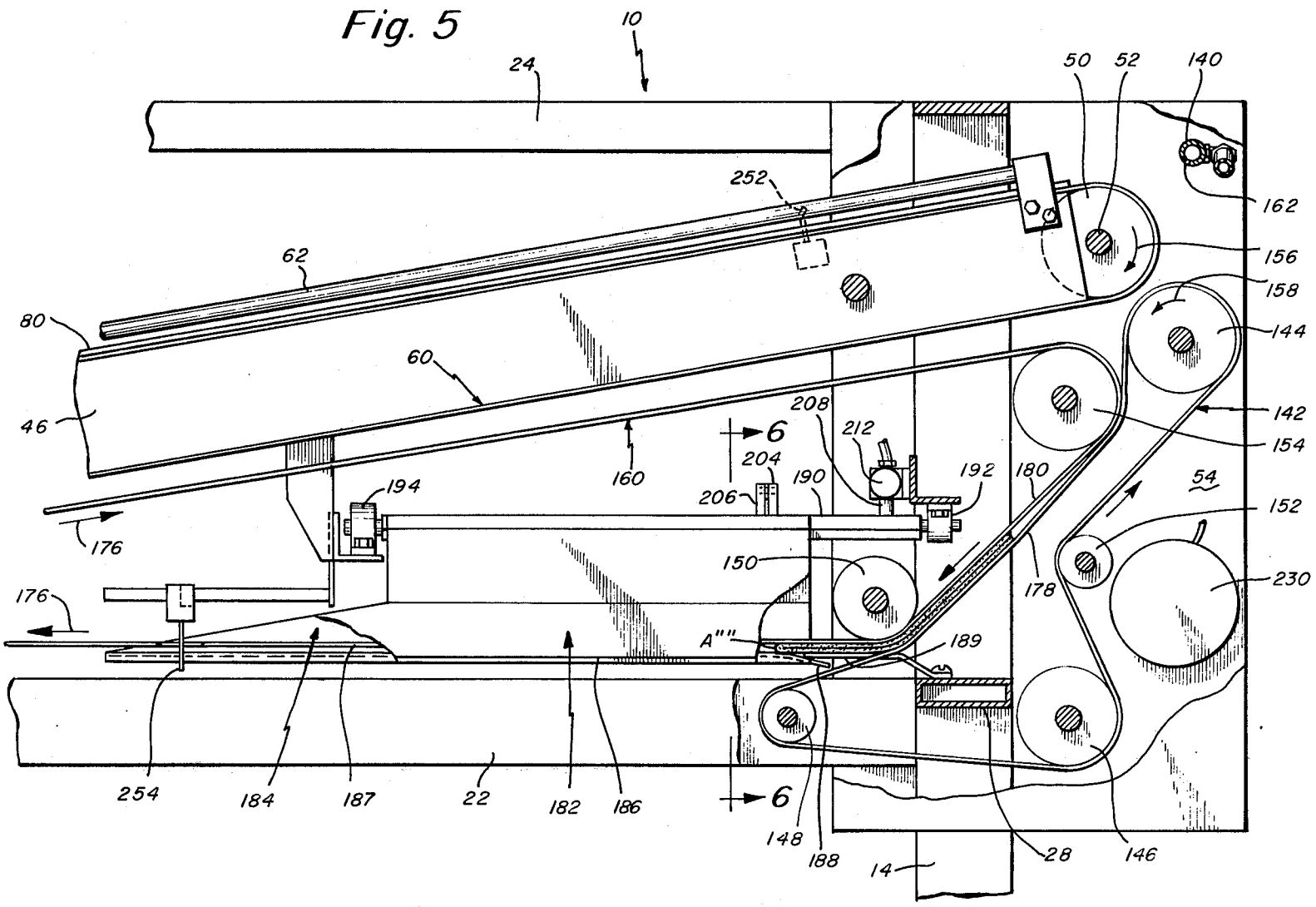
FIG. 5 is an enlarged fragmentary side view of the machine particularly illustrating how the cross fold is formed in the article.

A pair of width control blades 80 and 82 are supported at their forward ends by a width control assembly 84 shown in detail in FIGS. 3 and 4. Blades 80 and 82 lie on the upper surfaces of the upper runs of the feed conveyor belts **60*a* and 60*b*, respectively. The blades extend rearwardly on the belts from the control assembly 84 disposed closely adjacent the roller 42 which defines the forward end of the upper run of the feed belts. The blades 80 and 82 are not attached to the belts 60 so that the article to be folded conveyed on the belts may run underneath the blades. The opposite outer edges 86 of blade 80 and 88 of blade 82 define the fold lines for the length folds formed in the article. The width control assembly 84 enables the operator to select the desired distance between the opposite outside edges 86 and 88 so as to adjust and select the folded width of the article. Obviously narrower articles to be provided with a French fold comprising three panels of substantially equal width will require that the blades 80 and 82** be moved closer together than a wider article to be similarly folded.

As shown in FIG. 4 the forward ends of blades 80 and 82 are suspended from side blocks 90 and 92 respectively which in turn are slideably supported on shaft 94 that extends between the side panels 96 of the width control assembly housing 98. Width control shaft 100 is disposed above shaft 94 and has oppositely threaded sections 102 and 104 which are respectively threaded into the blocks 90 and 92. Center block 106 supports shafts 94 and 100 at their centers, and in turn is carried by bracket 108. The bracket in turn is carried on the free end of arm 110 pivotally mounted on shaft 112 that extends between the shaft brackets 113 on corner posts 12 of the main frame 10 of the machine.

To move the control blades 80 and 82 toward and away from each other so as to vary the spacing between the opposite fold edges 86 and 88, the operator turns control knob 114 fixed to the width control shaft 100. Rotation of shaft 100 causes the side blocks 90 and 92 to move axially on the oppositely threaded sections 102 and 104 of shaft 100, and the blocks slide toward or away from one another depending upon the direction of rotation of shaft 100, and carry with them the two width control blades 80 and 82.

Figure 2:
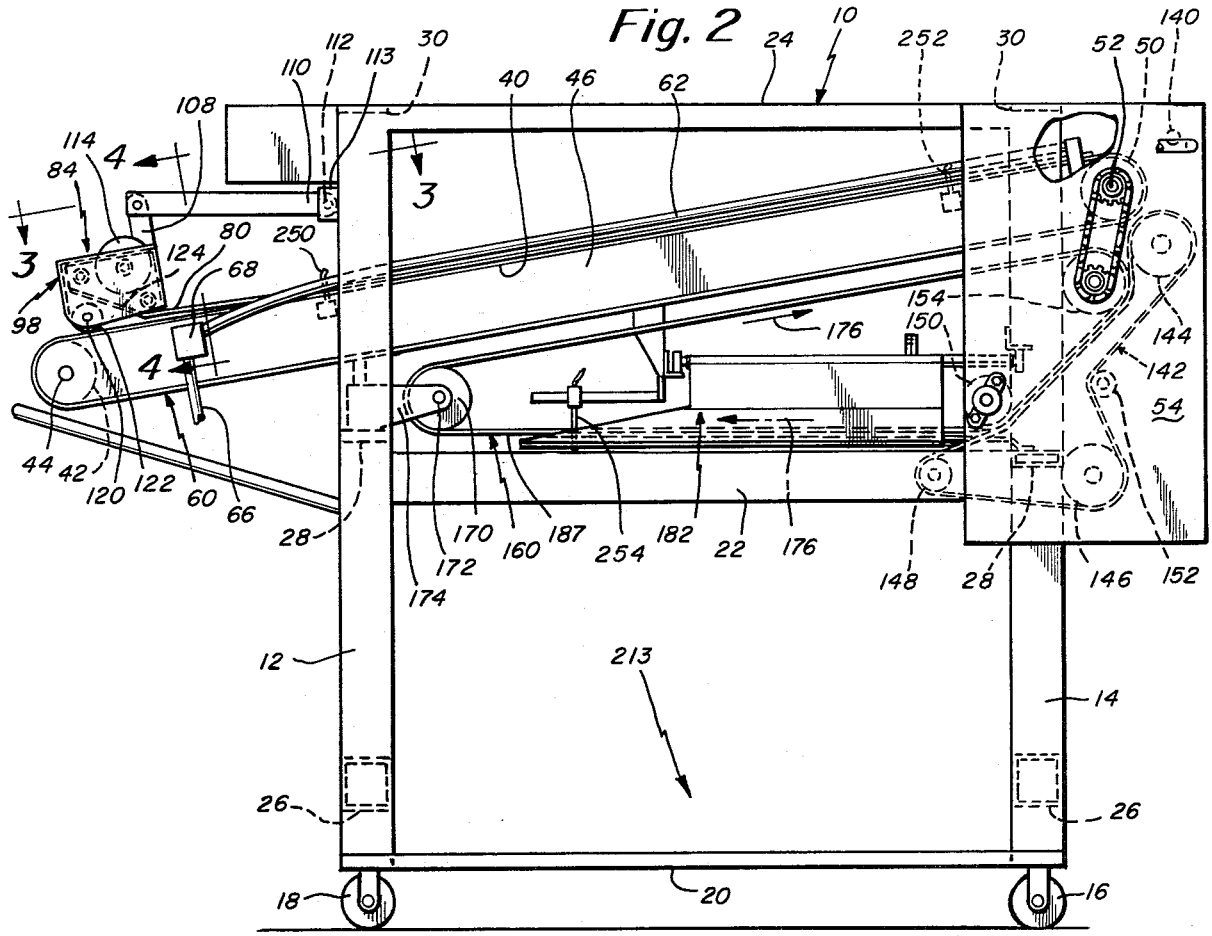
FIG. 2 is a side elevation view thereof.

As is evident in FIGS. 2–4, housing 98 carries yet another shaft 120 which in turn supports a roller 122 that rides on the upper course of the belts 60 and on roller 42 so as to support the width control assembly 84 in place. Because of the pivotal connections between bracket 108 and arm 110 and between arm 110 and shaft bracket 113, it is evident that the control assembly 84 is free to drop downwardly and roller 122 provides a rest position for the control assembly. Because the forward ends of blades 80 and 82 are bent upwardly on the front of side blocks 90 and 92 as suggested at 124, articles to be folded on the machine pass smoothly beneath the roller 122 and blades 80 and 82 and travel the course of the platform 40 on belt 60.

The manner in which the lengthwise folds are formed in the article by the apparatus thus far described is illustrated in FIG. 1. Article A is shown first as it is about to be fed onto the conveyor belts 60 beneath the width control blades 80 and 82. When fed onto the conveyor, the marginal portions A′ and A″ overlie the air tubes 62 and 64, respectively. After the front edge A‴ of article A travels a selected distance on the conveyor 60, a control circuit is actuated which first opens the valve 68 controlling the flow of air under pressure to tube 62, and the air exhausting out ports 70 folds the marginal portion A′ of the article over the top of blade 80 by blowing it over. Thereafter, the valve controlling the flow of air under pressure to tube 64 is opened, and the air jets flip the marginal portion A″ over the top of blade 82 and over the first folded marginal portion A′. The folding operations described above occur as the piece is being conveyed on feed belts 60 above platform 40.

The folder of this invention, as indicated above, also is equipped to cross fold the article after the length folds are formed about the blades 80 and 82. The cross fold is formed after the article has travelled the upper course of the feed conveyor belts 60. The cross fold is formed in the article by cross fold air tube 140 which extends between the plates 54 forming part of the frame, in cooperation with transfer belt 142 and its roller 144 which is in close proximity to the roller 50 that supports the rear end of feed belts 60.

As shown in FIGS. 1–5, transfer belt 142 is supported at its upper end by roller 144, and its course is also defined by drive roller 146 along with rollers 148, 150, 152 and 154. Rollers 150 and 154 also serve, as is described below, to define the course for stacker belt 160.

The rollers 50 and 144 which respectively support the rear extremity of feed belt 60 and the upper extremity of transfer belt 142 are themselves very closely spaced so as effective to form a pair of pinch rollers that define or form the cross fold in the piece. The belts 60 and 142 converge about their respective rollers 50 and 144 as suggested by arrows 156 and 158 in FIG. 5. When the cross line location of the article where the cross fold is to be formed lies opposite the opening between rollers 50 and 144, air under pressure is exhausted from cross fold air tube 140 through its jets 162 so that the line of the article is blown between the rollers 50 and 144 to form the fold. Air to the cross fold air tube 140 is controlled by a valve 164 which in turn is opened and closed by an electrical control circuit. That circuit is in turn controlled by a switch blade which is engaged by the piece as it travels along the feed conveyor 60.

The stacker belt 160 as shown in FIG. 2 is supported by rollers 150 and 154 along with a third roller 170 which is disposed just rearwardly of the front posts 12 of the frame on shaft 172 directly carried by brackets 174. Roller 154 is the drive roller for the stacker belt 160 and moves the belt in the direction suggested by arrows 176. After the fully folded article with its cross fold leading the way passes between pinch rollers 50 and 144, the article is conveyed between run 178 of transfer belt 142 and run 180 of the stacker belt 160 onto the stacker assembly 182. It is evident that the cross fold of the article is the forward edge in the completely folded piece as it moves between the run 178 and 180 onto the stacker assembly, as shown at A⁗ in FIG. 5.

The stacker assembly comprises a pair of drop plates 182 and 184 that include horizontal portions 186 which serve as a table or support for the articles as they are conveyed, fully folded, forwardly beyond the roller 148 of transfer belt 142. The drop plates lie immediately beneath the horizontal run 187 of the stacker belt 160, and the plates have rearwardly extending guides 188 that engage the article as it passes between roller 148 and 150 so that the article slides freely on the horizontal portions of the plates. Fingers 189 assist in carrying the articles onto the plates.

Drop plate 182 is carried on support bar 190 which is mounted on a pair of bushings 192 and 194 carried on brackets in turn mounted on cross braces of frame 10. Drop plate 184 is similarly supported on a support bar 196 carried by bushings on the frame. The support bars enable the drop plates to pivot from the position shown in full lines to the position shown in broken lines in FIG. 6, (as suggested by arrows 200) and the folded articles carried by the horizontal portions of the drop plate are free to drop onto the support provided at the bottom of the frame until a selected number of articles are stacked on it. Thereafter by any appropriate means (not shown) the stacked articles are carried away, bundled, and stored.

Figure 6:
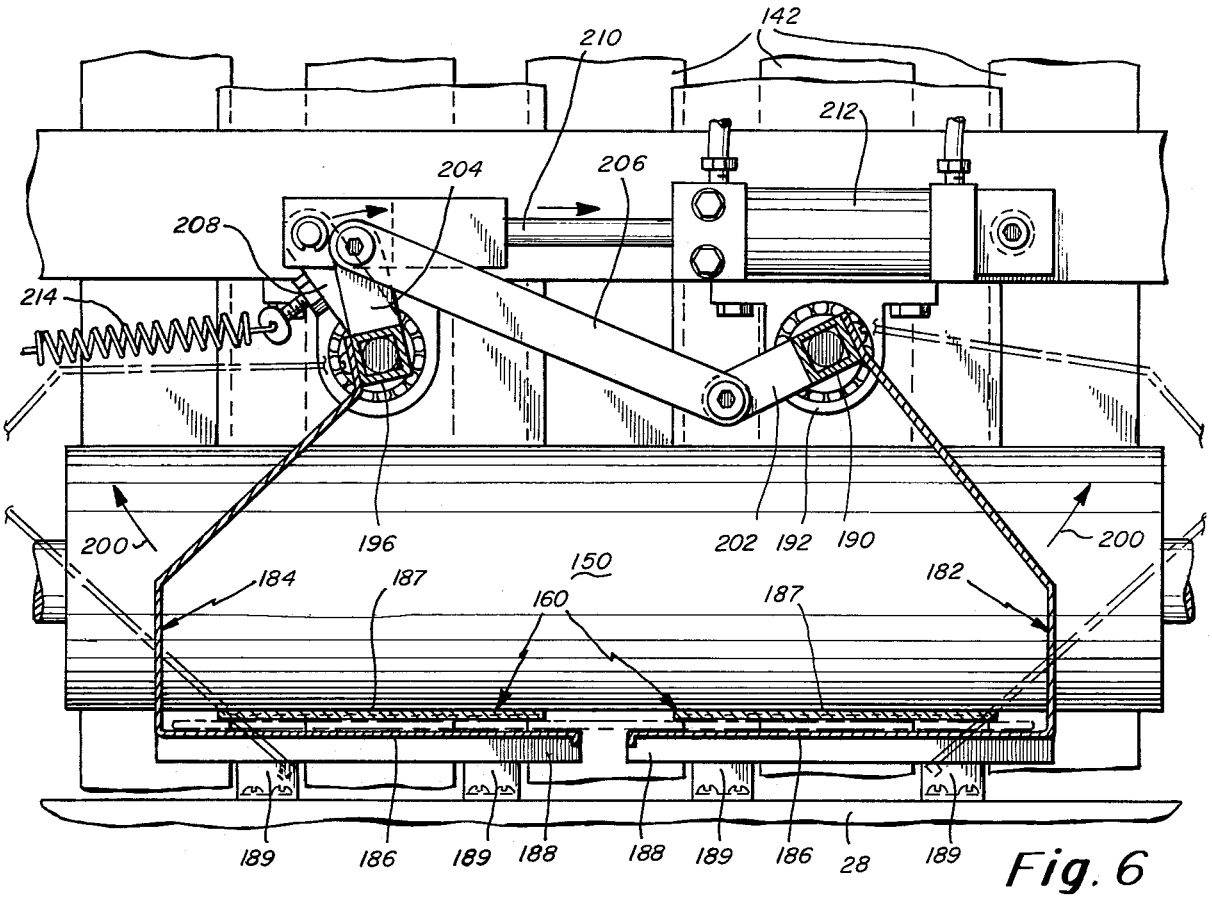
FIG. 6 is a cross sectional view taken along section line 6—6 of FIG. 5.
Figure 7:
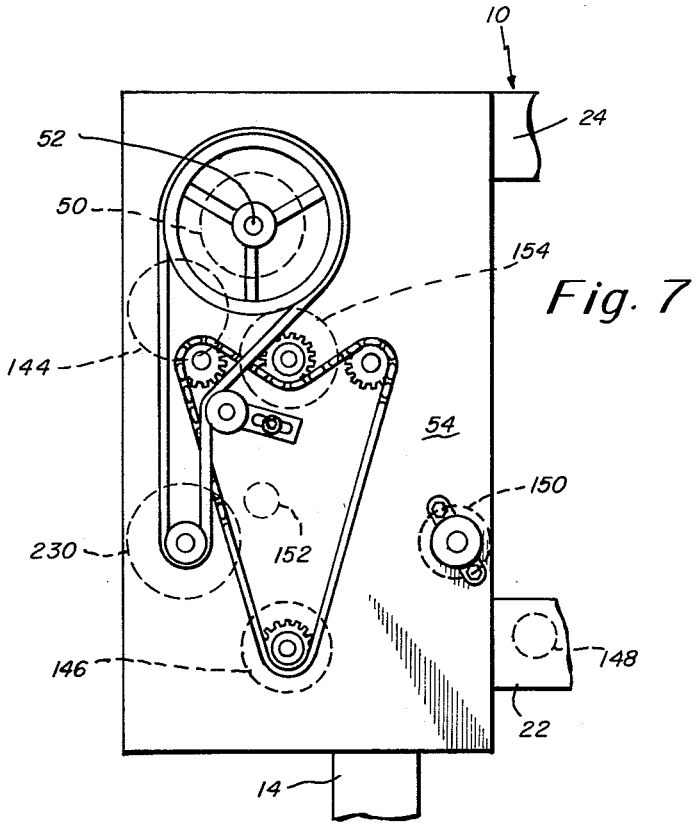
FIG. 7 is a fragmentary view of the machine showing a portion of the drive assembly.

The support bars 190 and 196 carry ears 202 and 204, respectively that are joined by link 206 pivotally connected to the respective ears at its ends. Rearwardly of ear 204 support bar 196 also carries a bracket 208 connected to the end of piston rod 210 of cylinder 212 forming part of the actuating mechanism for the stacker assembly. When air under pressure is directed to cylinder 212, its piston rod 210 is moved to the right as shown in FIG. 6, and support bar 196 turns clockwise which swings the drop plate 184 outwardly as suggested by arrow 200. That pivotal action of support bar 196 is also transmitted through link 206 to support bar 190, which causes the drop plate 182 to swing in the opposite direction. Any article carried on the horizontal portions of the drop plates is consequently discharged to the collector stationed 213 below the drop plates at the bottom of frame 10. When the cylinder 212 is deenergized, spring 214 connected between the frame 10 and the bracket 208 returns the support bars to the positions shown in the drawing, and the drop plates once again assume the full line position of FIG. 6.

The feed conveyor 60, transfer belt 142, and stacker belt 160 are all driven through their respective drive rollers by motor 230 mounted on plate 54 of frame 10. Chain and sprocket drives are mounted on the shaft 52 of roller 50 and the shaft of roller 146 so as to continuously drive the belts 60 and 142. While the conveyor belt 60 and 142 move continuously, the stacker belt 160 is designed to operate intermittently to deposit the folded articles on the drop plates and stop moving when the plates are temporarily opened to discharge the folded article. This intermittent drive is provided by the chain 249 (see FIG. 2) and a brake and clutch 296 of FIG. 8.

In FIG. 2 switch blade 250 of the first fold signal switch is shown to extend upwardly from the platform 40 between conveyor belts **60*a* and 60*b* in the path of all articles which are fed into the machine. The cross fold switch blade 252 also shown in FIG. 2 is similarly actuated by the leading edge of the piece as it moves up the feed conveyor. The third blade 254 shown disposed in the path of articles deposited on the drop plates 186 controls the operation of stacker. The stacker belt is momentarily stopped and the drop plates are opened when each article engages the blade 254**.

Figure 8:
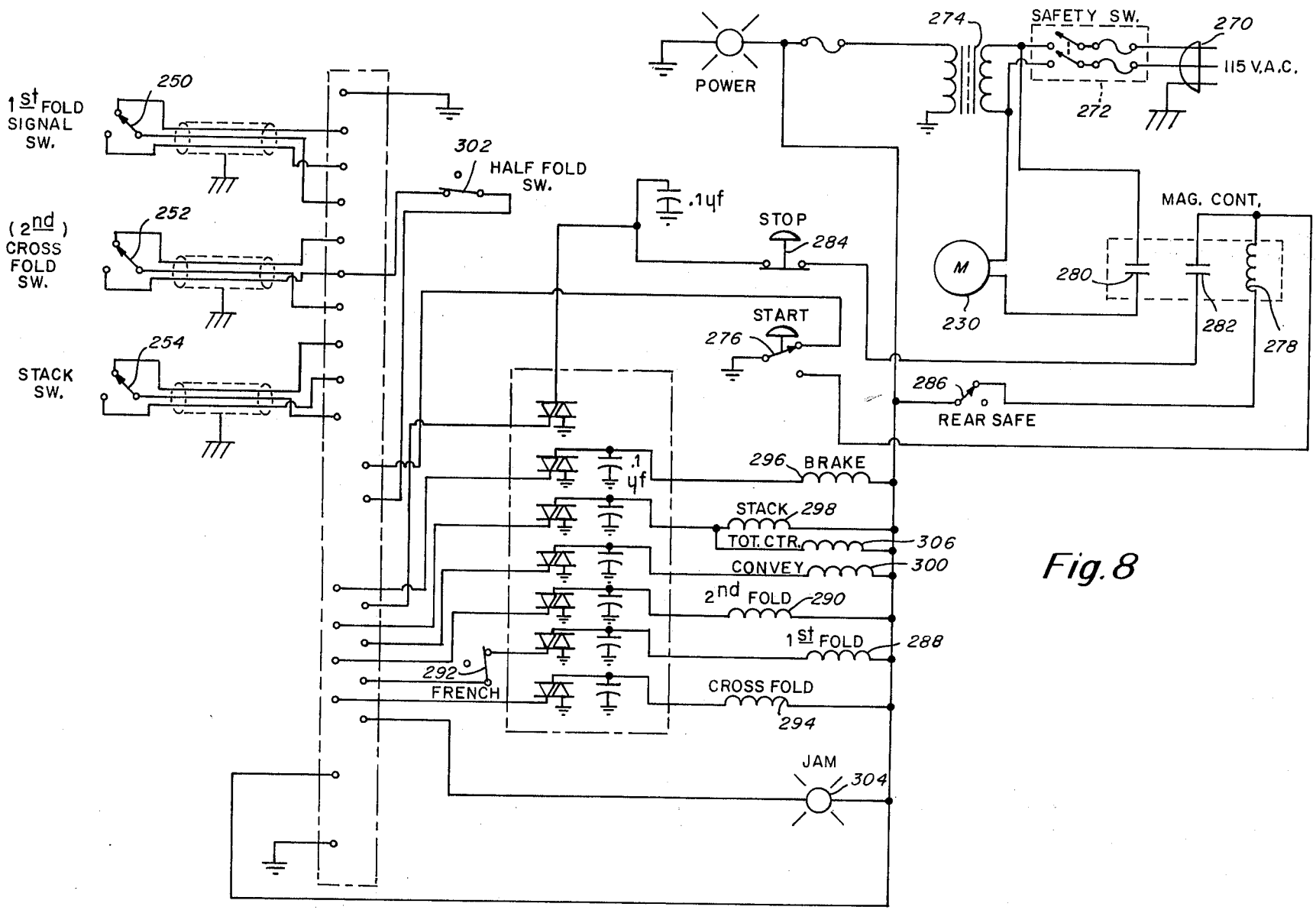
FIG. 8 is a schematic diagram of the electrical control assembly of the machine.

In FIG. 8 the control circuit for the machine is schemmatically shown and includes the main motor 230 and the three sensing switches 250, 252 and 254 that are actuated by the article being folded as it travels on the machine. The circuit includes the standard plug 270, safety switch 272 and transformer 274 which supplies 24 volt AC to the main control circuit. It will be noted that motor 230 is energized across the line on the primary side of the transformer.

The machine is started by depressing the starter button 276 which energizes the starter coil 278 which in turn closes relay switches 280 and 282 in the motor control circuit. Switch 282 is in operation. The motor may be stopped by either depressing the stop button 284 or by opening safety switch 286. The safety switch may be controlled by a guard, gate, or other safety device on the machine. Either the stop button 284 or or safety switch 286 will instantaneously shut down the system.

When the article to be folded is fed to the machine on feed conveyor 60 and beneath the control blades 80 and 82, its leading edge actuates the first fold switch blade 250, which energizes the coil 288 of solenoid valve 68, which opens the valve and jets of air discharge from tube 62 to fold the side of the article over control blade 80. After a time delay, the coil 290 of the solenoid valve of the second air tube 64 is energized to open that valve, and the second lengthwise fold is formed in the article. In the schematic, a manually operated disabling switch 292 is shown which when open eliminates the first fold by removing the coil 288 from the circuit. As a result, when but a single lengthwise fold is desired, the control blades are adjusted to the desired setting and the switch 292 is opened.

It will be appreciated that while the leading edge of the article actuates the blade 250, the rear edge of the article releases the blade 250. Consequently, the time between actuation and release of the blade is a measure of the article length. This information may be stored in a memory bank (not shown) which is ordinarily incorporated into the circuit. That information is used to determine the length of time that should elapse after actuation of cross fold switch blade 252 before the cross fold tube solenoid valve 164 is opened.

When switch 252 is actuated by the leading edge of the article, after a prescribed time delay as determined by the length of the article, the coil 294 of solenoid valve 164 is energized which causes valve 164 to open and the cross fold to be formed in the article as it passes between the rollers 50 and 144. As explained above, air jetting from the ports of the cross fold tube 140 causes the cross to be formed between the rollers.

The completely folded article is then transported to the drop plates 182 and ultimately the stacker switch blade 254 is actuated. When the switch 254 is actuated by the leading edge of the folded article, brake coil 296 is immediately energized which stops the stacking conveyor 160 and thereafter following a prescribed time delay, the coil 298 is energized which controls the solenoid valve for the stacker pneumatic cylinder 212. At the same time, actuation of the stacker switch blade 254 may send an impulse count to the memory circuit (not shown) and may energize a coil 300 which operates a discharge conveyor (not shown) to remove a prescribed number of collected articles stacked at the bottom of the frame.

The circuit also includes a bypass switch 302 that disables cross fold switch 252, if for any reason the operator wishes to eliminate the cross fold function of the machine. In addition, an alarm light 304 is provided which is lighted when more than a prescribed time elapses between actuation of the first fold switch 250 and the stacker switch 254. The The circuit also suggests the presence of a counter coil 306 that records the total count of articles folded by the machine.

From the foregoing description it is evident that this machine is capable of froming both French folds and cross folds in articles placed in it. The special adjustment provided by the control blades enables the operator to set the machine to accomodate the particular size of articles to be folded. Simply by turning the control knob 114 blades 80 and 82 are set at the desired positions. The machine is substantially less expensive to operate and maintain than machines presently available for performing the same functions, and the size of the machine enables it to be used in combination with several additional identical machines to fold the output of a large ironer.

Having described this invention in detail, those skilled in the art will appreciate that numerous modifications may be made thereof without departing from the spirit of this invention. Therefore, it is not intended that the scope of this invention be limited to the specific embodiment illustrated and described. Rather, it is intended that the scope of this invention be determined by the appended claims and their equivalents.

What is claimed is:

1. A small piece folder comprising a frame and means for continuously moving articles to be folded including a continuously moving feed conveyor mounted on the frame, a pair of width control blades mounted on the frame and overlying the continuously moving feed conveyor, means for feeding articles to be folded onto one end of the conveyor beneath the control blades, a pair of air tubes positioned to underly the margins of articles carried by the conveyor and having exhaust ports adapted to direct a blast of air upwardly to the side margins of articles as the articles are being moved by the feed conveyor to longitudinally fold the margins over the blades as the articles move, and control means including a valve for each of the tubes for sequentially directing compressed air to each to cause the folds to be made in sequence.

2. A small piece folder as described in claim 1 further characterized by a width control assembly mounted on the frame for moving the blades toward and away from each other, said assembly including a shaft, a pair of blocks mounted on the shaft and each connected to one blade, means connecting the blocks to the shaft causing the blocks to move in opposite directions when the shaft is turned, and a control for rotating the shaft.

3. A small piece folder as directed in claim 1 further characterized by said control means including a switch blade mounted on the frame adjacent the feed conveyor and actuated by the leading edge of the piece for energizing the control means to sequentially fold the piece over the edges of the blades.

4. A small piece folder as described in claim 1 further characterized by two pinch rollers mounted on the frame and having their circumferential surfaces forming a folding nip adjacent the other end of the feed conveyor and beyond the end of the blades, a cross fold air tube mounted on the frame adjacent the pinch rollers and having ports aligned with the folding nip, and a compressed air source and valve means connected to the cross fold air tube for blowing the piece between the pinch rollers to form a cross fold in the piece.

5. A small piece folder as described in claim 4 further characterized by means including a switch blade responsive to the length of the piece and mounted along the feed conveyor for energizing the cross fold air tube to fold the piece.

6. A small piece folder as described in claim 5 further characterized by a stacker assembly mounted on the frame adjacent the discharge side of the pinch rollers for receiving the folded piece after passing through the rollers, and means for opening the assembly after each piece is deposited on it for removing the folded piece from the folder.

7. A small piece folder as described in claim 4 further characterized by one of said pinch rollers supporting the other end of the feed conveyor, and a transfer conveyor mounted on the frame and in part supported by the other of the pinch rollers for moving the article after the cross fold is formed.

* * * * *